US005241884A

United States Patent [19]

Smithe et al.

[11] Patent Number: 5,241,884

[45] Date of Patent: Sep. 7, 1993

[54] APPARATUS FOR CHANGING THE LENGTH OF ENVELOPE BLANKS CUT FROM A CONTINUOUS WEB

[75] Inventors: Eliot S. Smithe, Hollidaysburg; Michael P. Lambert; Jason H. Wilkinson, both of Altoona, all of Pa.

[73] Assignee: F. L. Smithe Machine Company, Inc., Duncansville, Pa.

[21] Appl. No.: 775,336

[22] Filed: Oct. 11, 1991

[51] Int. Cl.[5] ..... B26D 5/20

[52] U.S. Cl. ..... 83/76; 83/298; 83/312; 83/369; 83/371; 226/195

[58] Field of Search ..... 83/76, 76.9, 76.7, 298, 83/312, 363, 367, 369, 370, 911, 371; 226/195

[56] References Cited

U.S. PATENT DOCUMENTS

| | | | |
|---|---|---|---|
| 2,981,134 | 4/1961 | Johnson | 83/312 X |
| 3,232,157 | 2/1966 | McMath et al. | 83/76 |
| 4,136,591 | 1/1979 | Helm et al. | 83/355 |
| 4,255,998 | 3/1981 | Rudszinat | 83/298 |
| 4,293,774 | 10/1981 | Pongracz | 250/548 |
| 4,380,943 | 4/1983 | Evans | 83/298 X |
| 4,574,563 | 3/1986 | Shimizu | 83/367 X |
| 4,655,067 | 4/1987 | Frost et al. | 83/367 X |
| 4,667,551 | 5/1987 | Kuromaru et al. | 83/370 X |
| 4,809,573 | 3/1989 | Welch | 83/370 X |
| 4,949,607 | 8/1990 | Yuito | 83/76.7 |
| 4,972,743 | 11/1990 | Nojima | 83/367 X |

FOREIGN PATENT DOCUMENTS 0011595 5/1980 European Pat. Off. .

*Primary Examiner*—Frank T. Yost
*Assistant Examiner*—R. Rada
*Attorney, Agent, or Firm*—Stanley J. Price, Jr.

[57] ABSTRACT

A pair of pull rolls unwind web material from a roll and advance the web at a preselected linear feed rate to a web cutting mechanism. The pull rolls are rotated at a preselected speed to generate the desired linear speed rate for cutting the web at selected intervals to produce blanks of a preselected length. The feed rolls are driven by a servo-motor which is operated by a controller that is microprocessor controlled. The controller is electrically connected to an encoder that is drivingly connected to a rotating knife cylinder of the web cutting mechanism. A selected length of blank to be cut from the web is inputted by the operator through a keypad to transmit a corresponding signal to the controller. In addition, the controller receives a signal from the servo-motor that drives the pull rolls, which signal is representative of the rate of rotation of the pull rolls. The inputs to the controller are compared to determine if the pull rolls are being rotated at the required speed to provide the linear feed rate that supplies the web to the cutter mechanism for producing blanks of a desired length. Should a deviation occur in the length of blank cut from the web, the controller detects the deviation and generates an output signal to the servo-motor to adjust the rate of rotation of the pull rolls.

9 Claims, 2 Drawing Sheets

APPARATUS FOR CHANGING THE LENGTH OF ENVELOPE BLANKS CUT FROM A CONTINUOUS WEB

BACKGROUND OF THE INVENTION

1. Field of the Invention

This invention relates to an envelope machine and more particularly to method and apparatus for changing and controlling the length of envelope blanks cut from a continuous roll of web material.

2. Description of the Prior Art

In an envelope machine, envelopes are formed by cutting envelope blanks from a continuous roll of web material. Pull rolls pull the web under tension from a reel at a preselected feed rate. The web is fed to a cutter station where discrete lengths of envelope blanks are cut from the web. The length of the envelope blanks is determined by the ratio between the number of cuts per minute and the rate at which the web is fed to the cutter station.

The conventional practice is to vary the length of the blanks cut from the web within certain limits depending on the nature of the envelope to be formed from the envelope blank. Once the blanks are formed, they are then fed on the envelope machine to subsequent stations at preselected time intervals to perform a number of other given operations on the envelope blank. For example, at the front end of the machine, the envelope blanks must be in proper position for a rotating cutter knife or a panel cutter to cut windows or panels in the blanks. Thereafter, the blanks must be in proper position when the bottom seal score is impressed on the blank. Each operation requires that the blanks be of uniform length and are continuously fed at a preselected speed. A variation in the web feed rate will alter the length of the envelope blanks cut from the web and accordingly affect the downstream operations performed on the envelope blanks. Therefore, it is essential that a selected feed rate be maintained so that the desired type of envelope is formed. This is particularly critical over a period of time when the machine components are exposed to wear and adjustments must be made to maintain a precise feed rate. When the length of the envelope blanks is to be adjusted, the feed rate must be adjusted to obtain the desired length of the envelope blank.

A conventional envelope machine includes a drive shaft that rotates at a preselected speed, and the web material is conveyed from a supply roll at a preselected speed relative to the speed of the drive shaft. Web cutting apparatus cuts the web material at preselected intervals to form various parts of the envelope blank, such as a bottom flap, a closure flap, side flaps, and a body portion of each envelope blank.

A drive mechanism is connected to the drive shaft and includes an output shaft driven at a predetermined speed relative to the speed of the drive shaft. The output shaft is, in turn, drivingly connected to the web feeding apparatus. The web feeding apparatus is then driven at a predetermined ratio relative to the speed of the drive shaft. With this arrangement, the drive mechanism is operable to change the speed of the output shaft relative to the speed of the drive shaft. This permits an adjustment to to be made in the length of the envelope blank cut from the web and accordingly permits a change in the configuration of the envelope blank so that, for example, the length of the bottom flap can be changed while the closure flap and the body portion of the envelope are maintained a fixed length.

It has been the conventional practice to provide adjustments in the length of the envelope blanks cut from the web by connecting the drive shaft through a change gear unit to the web feeding apparatus. A gear set is used for the desired length of cut. Each gear set corresponds to a different feed rate and length of cut. While a variation in the feed length is provided, the length of cut is preset in increments. Substantially, infinitely variable feed lengths are not available with gear sets in combination with a variable speed transmission.

The change in feed length using gear sets necessitates an interruption in the operation of the machine to change the setting. Once the setting is changed, trial runs must be performed to determine if the setting change produces the desired length of envelope blank cut from the web. If the length of the envelope blank should deviate from the required length, then adjustments to the gear set are required. Overall, the process of changing setting to change the length of the envelope blank is a time consuming operation. Furthermore, it necessitates the maintenance of a substantial inventory of gear sets to provide a full range of envelope blank sizes. U.S. Pat. Nos. 2,696,255; 3,056,322 and 3,128,662 are examples of envelope machines that utilize gear sets to provide adjustments in the length of envelope blanks cut from a web.

In an effort to increase the efficiency in changing the feed rate or the length of envelope blank cut from the web variable speed transmissions have been utilized to connect the main drive shaft with the web feeding apparatus. U.S. Pat. No. 4,020,722 discloses a cutting machine for cutting sheets from a web of paper in which a differential gear and a gear box drivingly connect the drive shaft to the web feeding apparatus. With this arrangement, the web feeding apparatus is driven at a preselected speed within a range without changing gear sets. The desired sheet length is set by setting the gear box at a ratio that drives the feeding apparatus for a preselected length of cut. Electrical pulses indicative of the speed at which the web is driven by the gear box are fed to a control unit and compared with the set sheet length. The comparison is computed and a resultant signal is transmitted to the pull rolls to correct the speed at which the web is fed to the cutter station.

U.S. Pat. No. 4,136,591 discloses in an envelope making machine apparatus for changing the length of envelope blanks cut from a continuous roll of web material in which a variable speed drive mechanism is connected to the drive shaft and includes an output shaft drivingly connected to web feeding apparatus. With this arrangement, the web feeding apparatus is driven at a predetermined ratio relative to the speed of the drive shaft. The variable speed mechanism is operable to change the speed of the output shaft relative to the speed of the input shaft to change the length of the bottom flap of an envelope blank while maintaining the closure flap and the body portion of the envelope a fixed length.

Other approaches to cutting envelope blanks of different lengths from a continuous web in envelope machines are disclosed in U.S. Pat. Nos. 1,837,727 and 3,056,322. U.S. Pat. No. 4,125,044 discloses in an envelope machine, a pair of feed rolls connected by a variable speed transmission to a drive motor. Cutting knives are positioned between the rollers. The rotational speed of the knives is adjusted relative to one another by the variable speed transmission.

U.S. Pat. No. 4,429,603 discloses in an envelope forming machine, a plurality of transmissions for obtaining desired speed ratios in adjusting the length of an envelope blank severed from the web. The relative gear ratios of the transmissions determine the length of the blank to be cut from the web and the length can be adjusted through the transmissions.

U.S. Pat. No. 3,244,045 discloses an input roller which feeds a strip of paper fed from a roll. The roller is drivingly connected through a gear train to a driven input shaft. A change gear in the gear train is mounted on an adjustable arm. The position of the arm is varied to accommodate different size change gears to vary the speed of the roller.

While it is known to provide adjustments in the length of the blank cut from a continuous web in an envelope making machine by change gears and by variable speed transmissions that transmit drive from the main drive shaft to the web feeding apparatus, the known devices are limited in the extent to which adjustments can be made in the length of the blank cut from the web. Specific lengths are provided for specific gear sets. The variable speed transmission provides a degree of infinite adjustment within a range of size but not outside the range. Also, with the known devices using a variable speed transmission when a correction or a change in the length of the blank is made, the machine must be stopped in order to determine if the cut length corresponds to the desired length. This a time consuming operation which interrupts the production of the envelope blanks. Therefore, there is need to provide in an envelope making machine apparatus that provides substantially infinite adjustment to the length of the envelope blank cut from the web. The machine must permit adjustments to be made while the machine is running to avoid the necessity of shutting down operation of the machine to determine if the envelope blanks being cut correspond to the correct length.

SUMMARY OF THE INVENTION

In accordance with the present invention, there is provided apparatus for changing the length of blanks cut from a continuous web of material that includes a machine frame. Cutter means rotatably supported in the machine frame severs the continuous web at preselected intervals to form blanks of a selected length. Cutter drive means rotate the cutter means at a preselected speed. Pull rolls rotatably supported in the machine frame feed the web of material from a roll to the cutter means at a preselected feed rate. Pull roll drive means rotate the pull rolls at a preselected speed. Control means electrically connected to the pull roll drive means adjust the rate of rotation of the pull rolls for a selected feed rate corresponding to a selected length of blank cut from the web. A first sensor is connected to the cutter means and generates an input signal representative of the position of the rotating cutter means to the control means. A second sensor is connected to the pull roll drive means and generates an input signal representative of the rotational speed of the pull rolls to the control means. Operator means electrically connected to the control means transmits an input signal to the control means corresponding to a selected length of blank to be cut from the web. The control means is responsive to the input signal received from the operator means and compares the input signals received from the first and second sensors with the input signal from the operator means to generate an output signal to the pull roll drive means to rotate the pull rolls at a preselected speed corresponding to the selected length of blank to be cut from the web and the position of the rotating cutter means with respect to the web.

Accordingly, the principal object of the present invention is to provide apparatus for changing and controlling the length of blanks cut from a continuous web of material.

Another object of the present invention is to provide method and apparatus in an envelope machine for adjusting the length of the envelope blank cut from the web through a substantially infinite range of selected lengths while the envelope machine continues to operate so that the envelope forming operation is not interrupted to change the length of the envelope blank.

Another object of the present invention is to provide apparatus for continuously monitoring the length of a blank cut from a web of material to maintain uniformity in the length of the blank and automatically make adjustments in the rate of feed of the web material to correct a deviation in the length of the blank.

An additional object of the present invention is to provide an envelope forming machine that includes apparatus for adjusting the length of envelope blanks cut from the web without the need for mechanical components, such as change gear sets or variable speed transmissions for driving the pull rolls, to reduce the maintenance requirements of the machine.

These and other objects of the present invention will be more completely disclosed and described in the following specification, the accompanying drawings, and the appended claims.

DESCRIPTION OF THE PREFERRED EMBODIMENTS

Figure 2:
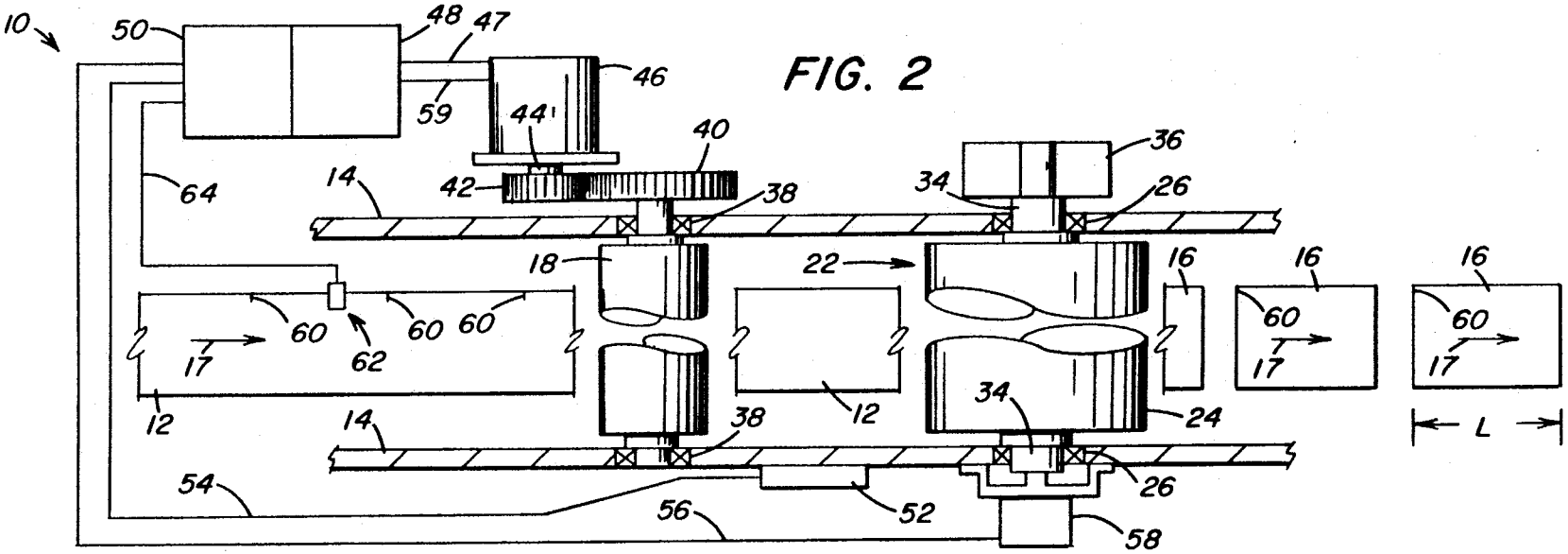
FIG. 2 is a top plan view of the envelope machine shown in FIG. 1.
Figure 1:
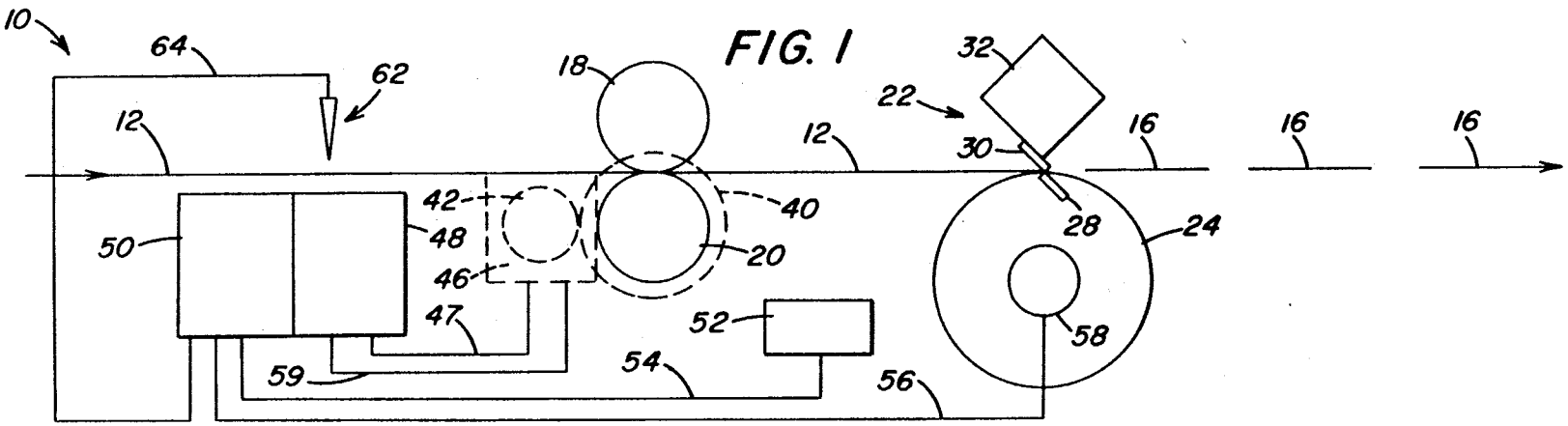
FIG. 1 is a schematic view in side elevation of an envelope machine, illustrating apparatus for adjusting and controlling the length of blanks cut from the web.

Referring to FIGS. 1 and 2, there is illustrated in an envelope blank forming machine a web cutting station generally designated by the numeral 10 that is positioned, for example, between an envelope blank gumming and folding station (not shown) and a supply reel or roll (not shown) of a continuous web 12 of paper. The web cutting station 10 is mounted in a frame 14 of the envelope machine as are the envelope blank gumming and folding station and the supply roll. Individual envelope blanks 16 of a preselected length L are cut from the web 12 at the station 10 and are conveyed therefrom in the direction indicated by arrow 17 to the adjacent envelope blank gumming and folding section. As well known in the art, at the envelope blank gumming and folding section, adhesive material is applied to selected margins of the envelope blanks, and the envelope blanks are folded to form an envelope as known in the art.

The continuous web 12 is unwound at a preselected linear speed from the web supply roll by a pair of pull rolls 18 and 20. The pull rolls 18 and 20 are rotatably journaled in overlying relation in the machine frame 14. The continuous web 12 of material passes between the rolls 18 and 20 which frictionally engage and exert tension on the web 12. A selected one of the rolls, for example, roll 20 is rotated at a preselected speed in accordance with the present invention to generate a selected linear feed rate of the web 12 corresponding to a preselected length L of blank to be cut from the web 12. The pull rolls 18 and 20 combine to pull the web material from the supply roll and feed the web 12 to a web cutting mechanism generally designated by the numeral 22.

The web cutting mechanism 22 includes a cylinder 24 rotatably supported by bearings 26 in the machine frame 14. The cylinder 24 includes a cutter knife 28 secured to the periphery of the cylinder 24 and extending parallel to the longitudinal axis thereof. The cutter knife 28 cooperates with a backing anvil 30 that is secured to an anvil holder 32. The anvil holder 32 is stationarily supported on the machine frame 14. The knife cylinder 24 includes a shaft 34 drivingly connected to a component 36 which is drivingly connected to a main drive shaft (not shown) of the envelope machine. The drive shaft of the envelope machine is driven at a preselected, fixed speed.

As the web 12 is fed by the pull rolls 18 and 20 to the web cutting mechanism 22, rotation of the cylinder 24 brings the knife 28 and anvil 30 into cooperating relationship to sever the web 12 at preselected intervals to form blanks 16 of a preselected length L as indicated in FIGS. 1 and 2.

The material of web 12 is unwound from a roll by the pair of the pull rolls 18 and 20. The rolls 18 and 20 rotate at a speed to obtain a desired linear rate of feed of the web 12 to the web cutting mechanism 22 to obtain the desired cut length of blanks 16. By varying the rate of rotation of the pull rolls 18 and 20 relative to rotation of the knife cylinder 24 for a constant rate of rotation of the main drive shaft, the rate of feed of the web 12 is varied to change the length of blank 16 cut from the web 12.

Both of the pull rolls 18 and 20 are rotatably supported by bearings 38 in the machine frame of 14. The pull rolls 18 and 20 is nonrotatably connected to a gear 40 that meshes with a gear 42 connected to an output shaft 44 of a servo-motor 46. The servo-motor 46 is electrically connected by conductor 47 to a servo drive 48 that is operated by a controller 50. The controller 50 is electrically operated by an operator controllable keypad 52 mounted on the machine frame 14. The keypad 52 is electrically connected to the controller 50 by conductor 54.

The keypad 52 and the controller 50 are microprocessor controlled and are thus programmed to receive input from the operator for setting the length of the blank 16 to be cut from the web. The machine operator numerically enters the length of the blank 16 to be cut from the web on the keypad 52. The keypad 52, in response to the input from the operator, generates a corresponding input signal representative of the desired feed length to the controller 50. The microprocessor of the controller 50 senses the input signal from the keypad 52 and converts the input signal to a responsive signal representative of the desired length of the envelope blank.

The controller 50 senses and receives an additional input signal through conductor 56 from an encoder 58 that is mechanically coupled to shaft 34 of the knife cylinder 24. With this arrangement, the encoder 58 is driven from the shaft 34 to generate an input signal that includes a number of pulses generated for each revolution of the cylinder 24. For example, the encoder generates a signal including 10,000 pulses per revolution of the cylinder 24. Thus, the pulsed signal from the encoder 58 is representative of the angular position of the cylinder 24 based on the number of pulses transmitted. Not only does the signal transmitted by the encoder 58 to the controller 50 indicate the number of pulses representative of the angular position of the cylinder 24, but also the pulses rate and any change in the pulse rate. Preferably, the knife cylinder 24 is rotated at a fixed speed from the main drive of the envelope machine; however, the speed may vary somewhat. Any variation is reflected in a rate of change of the pulsed signal from the encoder 58.

The controller 50 also senses and receives an input signal through conductor 59 transmitted by an encoder (not shown) coupled to the servo-motor 46. The input signal transmitted by the encoder of the motor 46 through conductor 59 to the controller 50 is representative of the rate of rotation of the pull rolls 18 and 20. Thus the controller 50 receives input signals from the keyboard 52 generated by the machine operator, a pulsed input signal from the encoder 54 representative of the angular position of the knife cylinder 24, and an input signal from the encoder of the servo-motor 46 representative of the rate of rotation of the pull rolls 18 and 20. The combined servo-motor 46 and servo-drive 48, controller 50 including microprocessor, keypad 52 and encoder 58 are commercially available devices and therefore will not be described in detail herein.

In operation, the desired length of the blank 16 cut from the web 12 is chosen by the operator and numerically entered on the keypad 52. In response to the input from the operator, the keypad 52 generates an input signal to the controller 50. The controller 50 compares the input signal from the keypad 52 with the input signal received from the encoder 58. As indicated, the input signal from the encoder 58 is a pulsed signal which is representative of the angular position of the knife cylinder 24 corresponding to the rate of rotation of the cylinder 24. The input signal from the keypad 52 is converted by the controller 50 to a signal representing the desired blank length L to be cut from the web 12. Accordingly, the blank length is determined by the feed rate of the web 12 to the web cutting mechanism 22.

The controller 50 converts the input signal from the keypad 52 and the encoder 58 to a ratio of the desired rate of rotation of the pull rolls 18 and 20 to the knife cylinder 24. In order for the controller 50 to actuate the servo-drive 48 to in turn operate the servo-motor 46 to rotate the pull rolls 18 and 20 at a preselected speed, the controller 50 must synchronize the rotation of the knife cylinder 24 with the rotation of the pull rolls 18 and 20 to obtain the desired linear feed rate corresponding to the selected blank length L.

Once the controller 50 determines the rate of rotation of the knife cylinder 24 by analyzing the pulsed signal from the encoder 58, the controller 50 determines the rate at which the pull rolls 18 and 20 must be rotated to generate the necessary feed rate of the web 12 so that upon rotation of the knife cylinder 24, the web is cut at specific intervals to obtain the desired length L of blank 16. The encoder associated with the servo-motor 46 transmits an input signal through conductor 59 to the controller 50 representative of the current rate of rotation of the pull rolls 18 and 20. From the input signal of the servo-motor encoder, controller 50 can then determine whether or not an adjustment needs to be made in the rate of rotation of the pull rolls 18 and 20 in response to the input signal received from the keypad 52.

The controller 50 compares the input signal from the encoder 58, the keypad 52 and the encoder of servo-motor 46 and generates a low voltage control signal to the servo-drive 48. In response to the low voltage signal from the controller 50, the servo-drive 48 generates a corresponding high voltage power signal through conductor 47 to the servo-motor 46. With this arrangement, the servo-motor 46 rotates the pull rolls 18 and 20 at a rate of speed for feeding the web 12 to the web cutting mechanism 22 to obtain a selected length L of blank 16.

Adjustments in the linear feed rate and corresponding blank length L can be made as the machine is operating. It is not necessary to interrupt operation of the pull rolls 18 and 20 to make adjustments in the linear feed rate. The controller 50 continuously receives the respective input signals so that in the event of a change in the rate of rotation of the knife cylinder 24 or a change in the rate of rotation of the pull rolls 18 and 20, an adjustment is made in the signal to the servo-motor 46 to maintain the desired linear feed rate for the selected length of blank 16. This arrangement constitutes a substantial improvement over the known devices for controlling the length of envelope blanks cut from the web that require change gears or variable speed transmissions.

With the present invention, adjustments in the linear feed rate are precisely made to generate an exact length of blank cut from the web. No trial and error efforts are required to determine if the adjustments in the linear feed rate produce the desired length of blank cut from the web. Further, by eliminating the need for gear sets and variable speed transmissions, a substantial number of mechanical components are removed from the machine. As a result, the extent of machine maintenance normally required is substantially reduced. Consequently, accuracy and repeatability of the web cutting station 10 is maintained because mechanical components prone to wear are eliminated.

The web cutting station 10 illustrated in FIGS. 1 and 2 also includes the provision of cutting the web 12 at selected points thereon to obtain blanks 16 of the desired length L. This feature is utilized with pre-printed web material. With pre-printed web material, not only must the web be cut in a selected blank length but the web must be precisely cut at specific points on the web. For example, as illustrated in FIG. 2, the web 12 includes a plurality of registration marks 60 longitudinally spaced along one margin of the web 12. Accordingly, the web 12 is to be cut at the registration marks, and the registration marks are spaced a distance apart corresponding to the desired length L of the blank 16. The position of the registration marks 60 is detected by a sensor generally designated by the numeral 62 that is positioned above the web 12 as the web is fed from the roll by the pull rolls 18 and 20.

In one example, the sensor 62 is a high speed photoelectric sensor which is commercially available. The sensor 62 is operable to detect the registration marks 60 as the web 12 is unwound from the roll. In response to the detection of the marks 60, the sensor 62 generates a responsive input signal through conductor 64 to the controller 50. From the signal received from the sensor 62, the controller 50 must determine whether or not the registration marks 60 are in phase, based on the linear feed rate, with the position of the knife cylinder 24. In other words, the controller 50 must determine whether the registration marks 60 are early or late in relationship to rotation of the knife cylinder 24.

In addition, the controller 50 monitors the ratio of rotation of the knife cylinder 24 to the length of blank cut from the web. In other words, for every revolution of the knife cylinder 24 the length of blank cut from the web 12 must correspond to the length of web between registration marks 60. Because the web 12 is pre-printed with the registration marks 60 the distance between the marks may vary as a result of the printing operation. For example for a complete roll of web material the registration marks 60 may vary an inch or more from the required distance apart over the length of the roll. Accordingly, adjustments must be continually made to assure severing of the web 12 at the registration marks 60.

The controller 50 compares the input signal from the encoder 58 with the input signal received from the sensor 62. If the signal from the encoder 58 is synchronized with the signal from the sensor 62, then the registration marks 60 are in phase with the knife cylinder 24 to cut the blanks 16 at the registration marks 60 In the event, the respective signals from the encoder 58 and the sensor 62 are not synchronized, the controller 50 determines what correction is required to place the registration marks 60 in registration with the knife cylinder 24.

Based on the extent of deviation in synchronization of the respective signals from the encoder 58 and the sensor 62, the controller 50 generates a correction signal to the servo-drive 48. The correction signal actuates the servo-drive 48 to change the rate of rotation of the servo-motor 46 to adjust the rotational speed of the pull rolls 18 and 20 and effect the necessary phase correction of the web 12 to the cutting mechanism 22 for cutting the web 12 at the registration marks 60.

In the instance where the distance between registration marks 60 deviates plus or minus from a set distance, for example 10 inches, the deviation is detected by the sensor 62 and a corresponding adjustment signal is sent to the controller 50. The controller 50 responds by comparing the input signal from the sensor 62 with the input signal from the encoder 58. The controller 50 then transmits a correction signal to the servo-drive 48 which responsively actuates the servo-motor 46 to adjust the rate of rotation of the pull rolls 18 and 20. The rate of rotation is either increased or decreased corresponding to the deviation in the distance between the registration marks from the set distance. In this manner, the linear feed rate of the web 12 to the cutting mechanism 22 is adjusted so that the web 12 is fed at the speed required to sever the web 12 at the registration marks 60 regardless of the distance between the registration marks.

Figure 4:
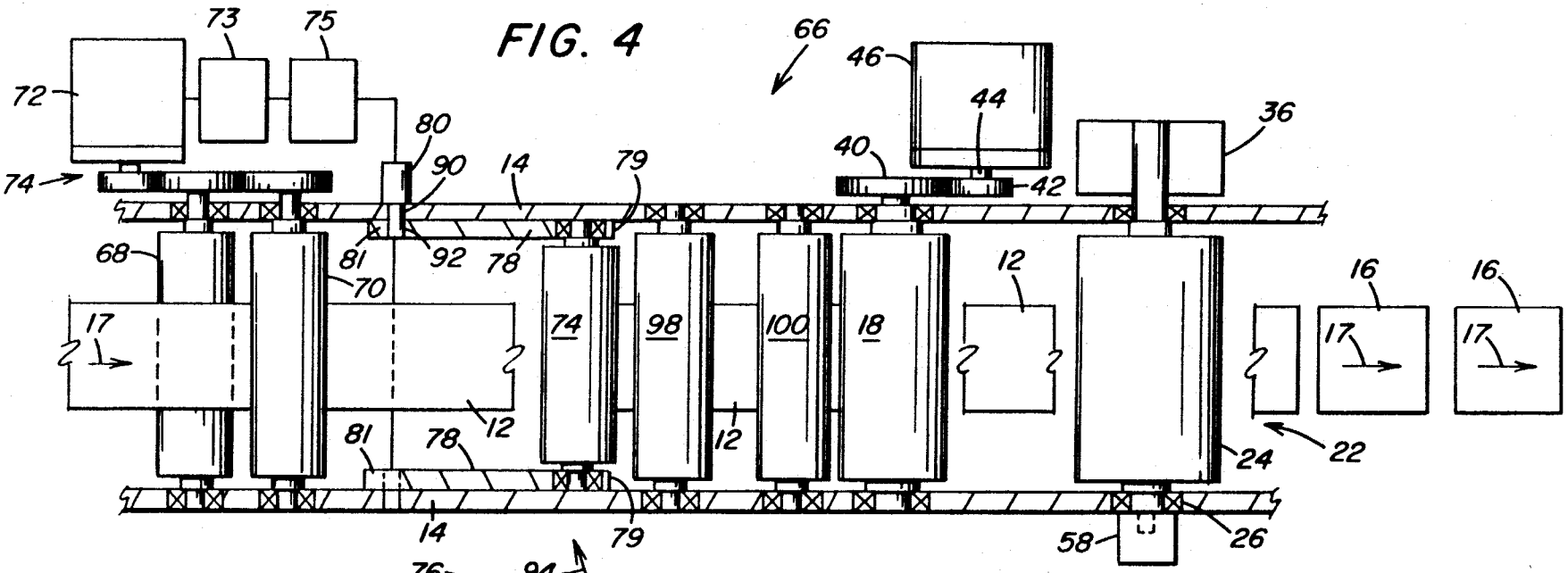
FIG. 4 is a top plan view of the envelope machine shown in FIG. 3.
Figure 3:
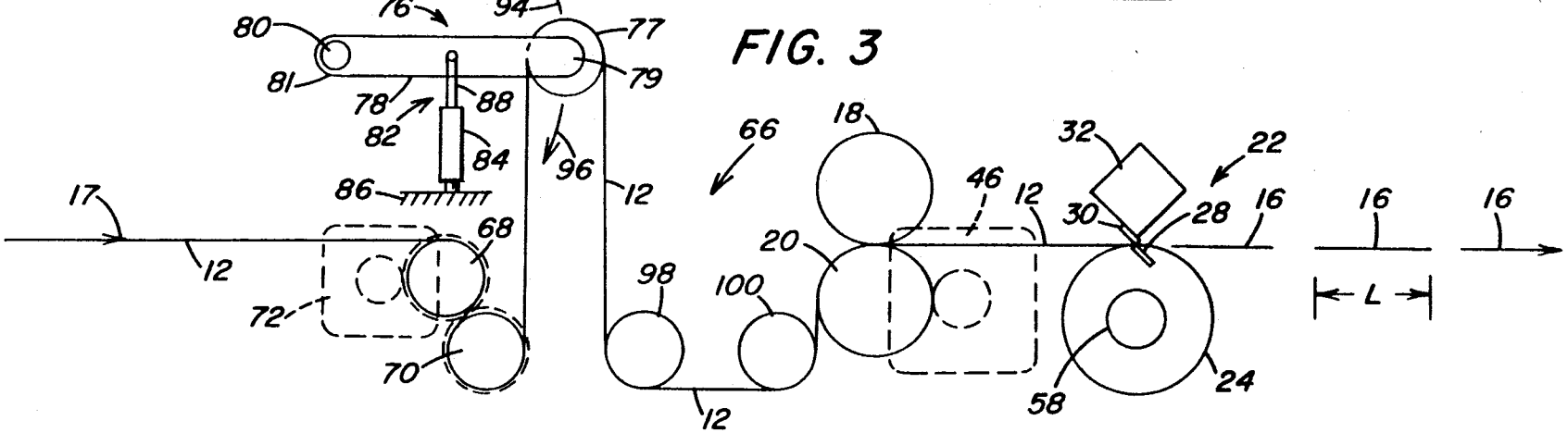
FIG. 3 is a schematic view similar to FIG. 1, illustrating apparatus for maintaining a constant tension on the web fed from the roll in response to changes in the feed rate when adjustments are made in the length of the blanks cut from the web.

Now referring to FIGS. 3 and 4, there is illustrated a further embodiment of the present invention which maintains a preselected tension on the web as it is unwound from a roll and in response to changes in the linear feed rate of the web 12. A web cutting station 66 is illustrated in FIGS. 3 and 4 and includes many of the same elements above-described with respect to the web cutting station 10 illustrated in FIGS. 1 and 2. Accordingly, like elements illustrated in FIGS. 1 and 2 are designated by like parts shown in FIGS. 3 and 4.

As with the arrangement illustrated in FIGS. 1 and 2, the pull rolls 18 and 20 advance the web 12 at a preselected linear feed rate to the web cutting mechanism 22. The web 12 is thereby cut at selected intervals to form blanks 16 having a selected length L. The pull roll 20 is rotated at a preselected speed as determined by the input from the keypad to the controller as above described with respect to the embodiment shown in FIGS. 1 and 2. The keypad and controller are not shown in the embodiment illustrated in FIGS. 3 and 4, but it should be understood that the same mechanism for controlling the operation of the servo-motor 46 in the prior embodiment is also utilized with the embodiment shown in FIGS. 3 and 4 and therefore is incorporated herein by reference.

In addition, a pair of secondary pull rolls 68 and 70 are rotatably mounted in the machine frame 14 and positioned upstream of the primary pull rolls 18 and 20. The secondary pull rolls 68 and 70 are rotated at a preselected speed by a DC motor 72 which is drivingly connected through a gear train generally designated by numeral 74 to the pull rolls 68 and 70. The DC motor 72 is actuated by a DC drive 73 which is, in turn, controlled by a controller 75 similar to control of servo-motor 46 by servo-drive 48 and controller 50 described above and illustrated in FIGS. 1 and 2.

The pull rolls 68 and 70 are rotatably supported in the machine frame 14 and are positioned in overlying laterally displaced relation so as to permit the web 12 to extend over and around the upper pull roll 68 and then down and around the lower pull roll 70. From the pull rolls 68 and 70, the web 12 is advanced at a selected linear feed rate vertically over an idler roll 77 that is rotatably mounted on the end of a dancer assembly generally designated by the numeral 76.

The dancer assembly 76 includes a pair of arms forming a frame 78 having the idler roll 77 at one end portion 79 and a potentiometer 80 at an opposite end portion 81 of the frame 78 which is pivotally connected to the machine frame 14. The frame 78 is connected intermediately to a piston cylinder assembly generally designated by the numeral 82. The assembly 82 includes a cylinder portion 84 supported by machine frame portion 86 and an extensible piston rod 88 connected at its upper end to an intermediate point on the frame 78. The piston rod 88 is subjected to a preselected air pressure, controlled by a pressure regulator, to exert a preselected force on the frame 78. Accordingly, the web tension can be changed by increasing or decreasing the pressure on piston rod 88.

The potentiometer 80 is attached to the machine frame 14 and includes a shaft 90 suitably coupled to a shaft 92 mounted on the dancer assembly frame 78. The potentiometer 80 is electrically connected to the controller 75 of DC motor 72. Upon pivotal movement of the dancer assembly frame 78 the potentiometer 80 generates an output signal. The voltage of the output signal increases or decreases depending upon the upward or downward movement of the potentiometer 80 and associated shaft 92 corresponding to the upward or downward movement of the idler roll 77 in the direction of arrows 94 or 96. Thus, as determined by the direction of movement of the shaft 92 the potentiometer 80 transmits an input signal to the DC controller 75 which, in turn, actuates the DC drive 73 to adjust the output of the DC motor 72 to effect a change in the speed of rotation of the pull rolls 68 and 70.

From the idler roll 74 the web 12 of material extends around idler rolls 98 and 100 which are also rotatably supported in the machine frame 14. From the idler rolls 98 and 100, the web 12 is fed through the pull rolls 18 and 20 to the web cutting mechanism 22 as discussed above with respect to the embodiment shown in FIGS. 1 and 2.

By adjusting the air pressure applied to the piston rod 88 extending from the cylinder 84, the dancer assembly frame 78 is pivoted on the machine frame 14 to position the idler roll 74 in a preselected position for exerting a desired tension on the web 12. Accordingly, the web tension can be changed by adjusting the force applied to the piston rod 88 in the cylinder 84.

The rate of rotation of the secondary pull rolls 68 and 70 must be synchronized with the rate of rotation of the pull rolls 18 and 20. The DC motor 72 drives the secondary pull rolls 68 and 70 and is electrically operated by the DC controller 75. Accordingly, when the speed of the servo-motor 46 is changed, the speed of the DC motor 72 must be changed. The controller 75, therefore, responds to a change in the speed of the servo-motor 46 to adjust the rate of rotation of the DC motor 72, and the rate at which the secondary pull rolls 68 and 70 are rotated.

In the event, the DC motor 72 should rotate the pull rolls 68 and 70 at a speed that results in overfeeding of the web 12 to the idler roll 74 on the dancer assembly 78, the tension in the web 12 decreases and the dancer assembly frame 78 pivots upwardly in the direction of arrow 94. Consequently, the potentiometer shaft 92 moves downwardly on the opposite end 81 of the frame 78 and thereby changes the position of the potentiometer 80 to decrease or trim the voltage of the signal transmitted to the DC motor 72 to reduce the speed of the motor and thereby decrease the linear feed rate. The speed of the DC motor 72, however, is principally determined by operation of the DC drive 73 through controller 75. Decreasing the linear feed rate of the web 12 increases the web tension and results in downward movement of the frame 78 in the direction of arrow 96 to substantially the midpoint position of travel shown in FIG. 3.

Correspondingly, as the dancer assembly frame 78 is drawn further downwardly at the end 79 by the tension of the web 12, the speed of the DC motor 72 increases relative to the speed of the servo-motor 46 for the main pull rolls 18 and 20 and more paper is pulled from the web supply roll.

In the event the web 12 is underfed by the secondary pull rolls 68 and 70, i.e. the tension in the web 12 increases, the dancer assembly frame 78 responds by pivoting downwardly in the direction of arrow 96. Consequently, the potentiometer 80 responds by increasing the voltage of the signal transmitted to the DC controller. The DC drive 73 responds to accelerate the speed of motor 72 to increase the rate of rotation of the pull rolls 68 and 70 to decrease the tension on the web 12 and allow the frame 78 to pivot to the pre-set position.

The potentiometer 80 responds constantly to the relative movement of the frame 68 in response to the tension applied to the web 12. In this manner, the tension in the web 12 is substantially maintained constant. Under equilibrium conditions, the tension in the web 12 is proportional to the force applied by the piston cylinder assembly 82 to the frame 78. The piston cylinder assembly maintains a constant force on the dancer assembly 76, which force may be adjusted to adjust the present tension in the web 12. In the event, the pull rolls 68 and 70 unwind the web from the roll resulting in a change in the tension of the web 12, a correction signal is transmitted to the DC controller 75 to adjust the rate of rotation of the rolls 68 and 70 so that the tension in the web 12 is restored to the desired level. The above described arrangement for maintaining a relatively constant tension on the web 12 can be positioned at any point on the envelope machine where it is desired to control the tension in the web at a specific zone or area of the machine.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described herein.

We claim:

1. Apparatus for changing the length of blanks cut from a continuous web of material comprising, a machine frame, cutter means rotatably supported in a preselected angular position in said machine frame for severing the continuous web at preselected intervals to form blanks of a selected length, cutter drive means for rotating said cutter means at a preselected speed, pull rolls rotatably supported in said machine frame for feeding the web of material unwound from a roll to said cutter means at a preselected feed rate, pull roll drive means for rotating said pull rolls at a preselected rotational speed, control means electrically connected to said pull roll drive means for adjusting the rate of rotation of said pull rolls for a preselected feed rate corresponding to a preselected length of blank cut from the web, a first sensor connected to said cutter means for generating input signals representative of the position of the rotating cutter means to said control means, a second sensor connected to said pull roll drive means for generating an input signal representative of the rotational speed of said pull rolls to said control means, operator means electrically connected to said control means for transmitting an input signal to said control means corresponding to a selected length of blank to be cut from the web, web sensor means mounted on said machine frame for detecting registration marks imprinted on the web and spaced a distance apart corresponding to the preselected length of blank to be cut from the web, said web sensor means being operable to transmit an input signal to said control means representative of the relative position of the registration marks as the web is fed to said cutter means, and said control means receiving said input signal from said web sensor means and said input signals from said first sensor to determine if the registration marks are in phase with the position of said cutter means for severing the web at the registration marks.

2. Apparatus as set forth in claim 1 in which, said control means determines if the registration marks are not in position for cutting the web at the registration marks and generates a correction signal to said pull roll drive means to change the rate of rotation of said pull rolls so that the web is fed to said cutter means at a feed rate for severing the web at the registration marks.

3. Apparatus as set forth in claim 1 in which, said web sensor means includes a photoelectric sensor positioned oppositely of a feed path of the web supplied from the roll and being operable to detect the registration marks as the material is unwound and fed to said pull rolls, and said sensor being further operable to generate an input signal to said control means upon detection of a registration mark passing said sensor.

4. Apparatus for changing the length of blanks cut from a continuous web of material comprising, a machine frame, cutter means rotatably supported in a preselected angular position in said machine frame for severing the continuous web at preselected intervals to form blanks of a selected length, cutter drive means for rotating said cutter means at a preselected speed, pull rolls rotatably supported in said machine frame for feeding the web of material unwound from a roll to said cutter means at a preselected feed rate, pull roll drive means for rotating said pull rolls at a preselected rotational speed, control means electrically connected to said pull roll drive means for adjusting the rate of rotation of said pull rolls for a preselected feed rate corresponding to a preselected length of blank cut from the web, a first sensor connected to said cutter means for generating input signals representative of the position of the rotating cutter means to said control means, a second sensor connected to said pull roll drive means for generating an input signal representative of the rotational speed of said pull rolls to said control means, tension adjustment means for maintaining a desired tension in the web as the web is unwound from the roll, tension sensor means for sensing the tension in the web being fed to said cutter means, responsive means for connecting said tension adjustment means to said tension sensor means such that in the event said tension sensor means detects a deviation in the web tension from the desired tension, said tension adjustment means is actuated to adjust the web tension to the desired tension, operator means electrically connected to said control means for transmitting an input signal to said control means corresponding to a selected length of blank to be cut from the web, said control means being responsive to the input signal received from said operator means to compare the input signals received from said first and second sensors with the inputs signals from said operator means to generate an output signal to said pull roll drive means to rotate said pull rolls at a preselected speed corresponding to the selected length of blank to be cut from the web and the angular position of the rotating cutter means with respect to the web.

5. Apparatus as set forth in claim 4 in which, said tension adjustment means includes a pair of secondary pull rolls rotatably mounted in said machine frame and upstream of said first mentioned pull rolls, a drive motor drivingly connected to said secondary pull rolls, a controller electrically connected to said drive motor for adjusting the speed of said drive motor, and said tension sensor means being electrically connected to said controller for actuating said controller to adjust the speed of said drive motor in response to a change detected by said tension sensor means in the web tension.

6. Apparatus as set forth in claim 5 in which, said tension sensor means includes a pivotally mounted frame, a potentiometer mounted at one end of said frame and electrically connected to said controller, an idler cylinder mounted at an opposite end of said frame for pivotal movement, said idler cylinder supporting said web such that said idler cylinder is pivoted to a preselected position for applying the desired tension in the web, and means for pivoting said frame to a preselected position to move said idler cylinder to a position for maintaining the desired tension on the web.

7. Apparatus as set forth in claim 6 in which, said potentiometer is operable to transmit to said controller an output signal representative of the position of said idler cylinder for actuating said drive motor to rotate said secondary pull rolls at a preselected speed, and said drive motor being adjusted to control the rate of rotation of said secondary pull rolls and the tension applied to the web in response to movement of said potentiometer from a preselected position corresponding to the desired tension to be maintained on the web.

8. Apparatus for maintaining a desired tension in a web of material fed from a roll to an envelope making machine comprising, a frame of an envelope making machine, primary pull rolls rotatably supported in said frame for feeding the material along a feed path at a preselected feed rate on said frame, primary drive means for rotating said primary pull rolls at a preselected speed to obtain the preselected feed rate of the material on said frame, secondary pull rolls rotatably supported in said frame upstream of said primary pull rolls in the feed path of the material, secondary drive means for rotating said secondary pull rolls to unwind the material from the roll and advance the material in the feed path to said primary pull rolls, tension adjustment means for maintaining a desired tension in the material as the material is unwound from the roll by said secondary pull rolls and fed to said primary pull rolls, said tension adjustment means being mounted on said frame in the feed path of the material between said primary pull rolls and said secondary pull rolls, and control means for drivingly connecting said tension adjustment means to said secondary drive means for adjusting the rate of rotation of said secondary pull rolls to feed the material to said primary pull rolls at a feed rate for maintaining a substantially constant tension in the material fed to said primary pull rolls.

9. Apparatus for maintaining a desired tension in a web of material fed from a roll to an envelope making machine comprising, a frame of an envelope making machine, primary pull rolls rotatably supported in said frame for feeding the material along a feed path at a preselected feed rate on said frame, primary drive means for rotating said primary pull rolls at a preselected speed to obtain the preselected feed rate of the material on said frame, secondary pull rolls rotatably supported in said frame upstream of said primary pull rolls in the feed path of the material, secondary drive means for rotating said secondary pull rolls to unwind the material from the roll and advance the material in the feed path to said primary pull rolls, tension adjustment means for maintaining a desired tension in the material as the material is unwound from the roll by said secondary pull rolls and fed to said primary pull rolls, said tension adjustment means being mounted on said frame in the feed path of the material between said primary pull rolls and said secondary pull rolls, control means for drivingly connecting said tension adjustment means to said secondary drive means for adjusting the rate of rotation of said secondary pull rolls to feed the material to said primary pull rolls at a feed rate for maintaining a substantially constant tension in the material fed to said primary pull rolls, said tension adjustment means includes a pivotal frame having opposite ends and a pivot point therebetween, an idler cylinder mounted at one end of said pivotal frame, said idler cylinder supporting the material as the material is fed from said secondary pull rolls to said primary pull rolls, a potentiometer mounted at the opposite end of said pivotal frame and electrically connected to said control means to generate a signal to said control means for actuating said control means to operate said secondary drive means for rotating said secondary pull rolls at a preselected speed, means connected to said pivot point for pivoting said frame to a preselected position for moving said idler cylinder to a position for maintaining a desired tension in the material, and said potentiometer being responsive to a change in the position of said idler cylinder such that said control means is actuated to initiate a change in the speed of rotation of secondary pull rolls for maintaining the desired tension in the material.

* * * * *